US005104073A

United States Patent [19]

VanBeek et al.

[11] Patent Number: 5,104,073

[45] Date of Patent: Apr. 14, 1992

[54] ARM AND HAND REST FOR A KEYBOARD

[76] Inventors: Allen L. VanBeek, 7115 Antrim Rd., Edina, Minn. 55435; Thersea J. Hill, 7012 Dallas Rd., Brooklyn Center, both of Minn. 55435

[21] Appl. No.: 567,818

[22] Filed: Aug. 15, 1990

[51] Int. Cl.[5] ..... H05F 3/00

[52] U.S. Cl. ..... 248/118.3; 248/918; 248/285

[58] Field of Search ..... 248/118, 118.1, 118.2, 248/118.3, 918, 285; 400/715

[56] References Cited

U.S. PATENT DOCUMENTS

| | | | |
|---|---|---|---|
| 2,602,488 | 7/1952 | Conning | 248/118 X |
| 3,114,527 | 12/1963 | Demarert | 248/118 |
| 4,482,064 | 11/1984 | Berke et al. | 248/118 X |
| 4,562,987 | 1/1986 | Leeds et al. | 248/918 |
| 4,619,427 | 10/1986 | Leymann | 248/918 X |
| 4,779,922 | 10/1988 | Cooper | 248/918 X |
| 4,913,390 | 4/1990 | Berke | 248/918 X |

*Primary Examiner*—Alvin C. Chin-Shue
*Attorney, Agent, or Firm*—Hugh D. Jaeger

[57] ABSTRACT

Arm and hand rest for a keyboard, such as a stenographers' machine keyboards or computer keyboard, including a padded foamed longitudinal rectangular keyboard member with rounded ends, the underside of the rectangular member including flanges for pivotable mounting on two configured supports. The configured supports mount to a base, the base secures to a screw housing which includes a screw and a knob height adjustment. A hole extends upwardly through the screw housing and the base for accommodating the upper section of a tripod which slides vertically through the hole. The arm and hand rest can also be attached for three dimensional movement about a computer keyboard. The arm and hand rest is intended for preventing carpal tunnel syndrome and other repetitive strain injuries.

2 Claims, 7 Drawing Sheets

ARM AND HAND REST FOR A KEYBOARD

BACKGROUND OF THE INVENTION

1. Field of the Invention

The present invention pertains to an arm and hand rest for a keyboard, and more importantly, pertains to a padded longitudinal member for a keyboard for preventing carpal tunnel syndrome (CTS), and repetitive strain injuries (RSI)

2. Description of the Prior Art

Court reporters, as well as keyboard operators, have been subject to on-the-job medical conditions of carpal tunnel syndrome (CTS) and repetitive strain injuries (RSI) which are briefly described as nerve compression and other nerve or irritation symptoms. These symptoms lead to limited movement of one's hands and fingers, and also accounts for pain to an individual's hands and fingers. Sunderland has compiled evidence for the most cogent theory to explain the events producing carpal tunnel compression syndrome (CTS) and other nerve irritations. His basic principle implicated a low flow state beginning in the venous micro-circulation supplying the affected nerve and producing a progressive relative ischemia. This ischemia of the nerve is caused by prolonged abnormal positioning and posturing of the arm and hand. Another causative factor is the highly repetitive movement of the wrist or elbow. While this may not be the only theory supported by clinical observations, it is one theory. Other theories await the development of dynamic techniques to evaluate the actual flow rates and micro vasculature of the peripheral nerves. While there are treatments for CTS and RSI, the symptoms and manifestations of the disease are not always treatable medically or even through surgical procedures. Operative techniques are not always successful based on the numerous medical considerations and causes.

While sometimes the symptoms can be treated through procedures for better micro-circulatory flow, the nerve impulse conduction may not be fully facilitated. Restoration of the micro-circulation of the nerve fascicles may not always be achieved, and internal scarring of the nerve may follow prolonged repetitiveness of ischemia.

The present invention overcomes the medical problems in a preventative nature by providing a padded arm and hand rest. This device permits the user to rest the joints of the arm and hand in proper position and posture. This mitigates against the development of symptoms produced by nerve irritation and ischemia produced by abnormal position or positional tension.

SUMMARY OF THE INVENTION

The general purpose of the present invention is to provide an arm and hand rest for individuals using keyboards so as to prevent the occurrence of carpal tunnel syndrome (CTS) and other repetitive strain injuries (RSI). The arm and hand rest provides a padded arm so that an individual can rest the wrist and elbow during the procedures of utilizing a stenography machine, typewriter or keyboard. The arm and hand rest is three dimensionally adjustable to permit positioning about the approximate height of the keyboard, and provides for spacing of the wrists and for relaxation of the wrists and arms while the fingers can still be poised on the keys.

According to one embodiment of the present invention, there is provided an arm and hand rest including a padded foamed member with slight curvature; a longitudinal rectangular member with rounded ends for capturing the padded foam member; flanges on a lower side of the longitudinal rectangular member for pivotable mounting; two configured supports, including holes at one end for engagement within the flanges and screws securing the flanges about each end of the configured support, the configured supports held within a base with wrap-around ends, the wrap-around ends secured back upon the base with screws, the base secured to a screw housing with nut and bolt assemblies, or like assemblies; and the screw housing including a screw with a knob for securing to an upright tubular member through a hole in the base and the screw housing. The padded foam in the rectangular support member is three dimensionally adjustable.

The most significant aspect and feature of the present invention is a padded arm and hand rest which provides for support of an individual's lower arms and wrists during procedures, such as those utilized during transcriptions of depositions, sessions during court reporting, or keyboard procedures, and for preventing carpal tunnel syndrome (CTS) and other repetitive strain injuries (RSI).

Another significant aspect and feature of the present invention is an arm and hand rest which is three dimensionally adjustable. The arm and hand rest can be adjusted to any height with respect to a keyboard, and at any distance with respect to the keyboard accordingly.

Having thus described the embodiments of the present invention, it is the principal object hereof to provide an arm and hand rest for use with a word processor keyboard or a stenography machine which prevents carpal tunnel syndrome (CTS) and other repetitive strain injuries (RSI).

One object of the present invention is a padded arm and hand rest which is three dimensionally adjustable with respect to a keyboard, such as a stenography machine.

Another object of the present invention is a padded arm and hand rest which has three degrees of adjustability, providing for three dimensional movement with respect to a keyboard.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
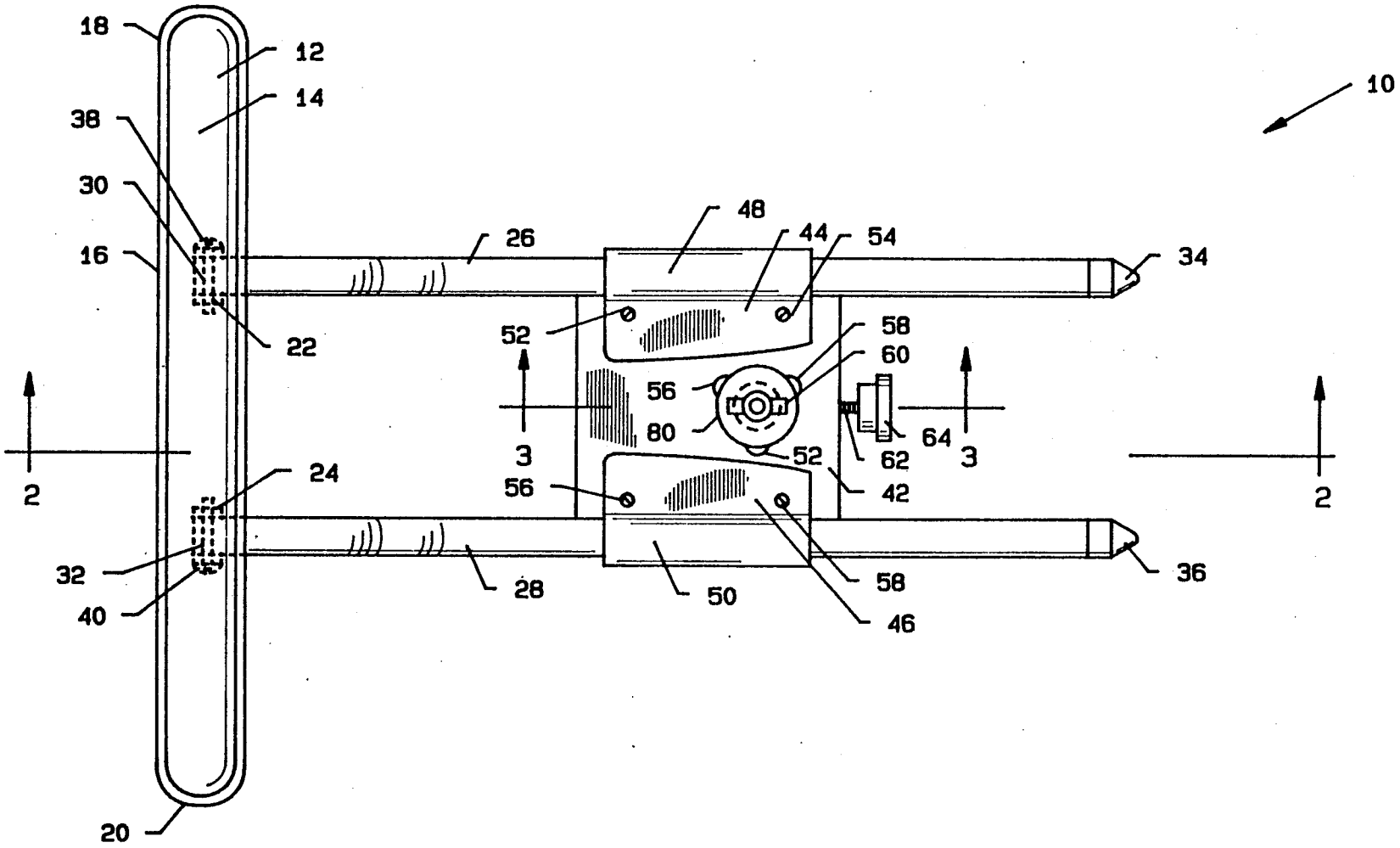
FIG. 1 illustrates a top view of an arm and hand rest, the present invention.
Figure 2:
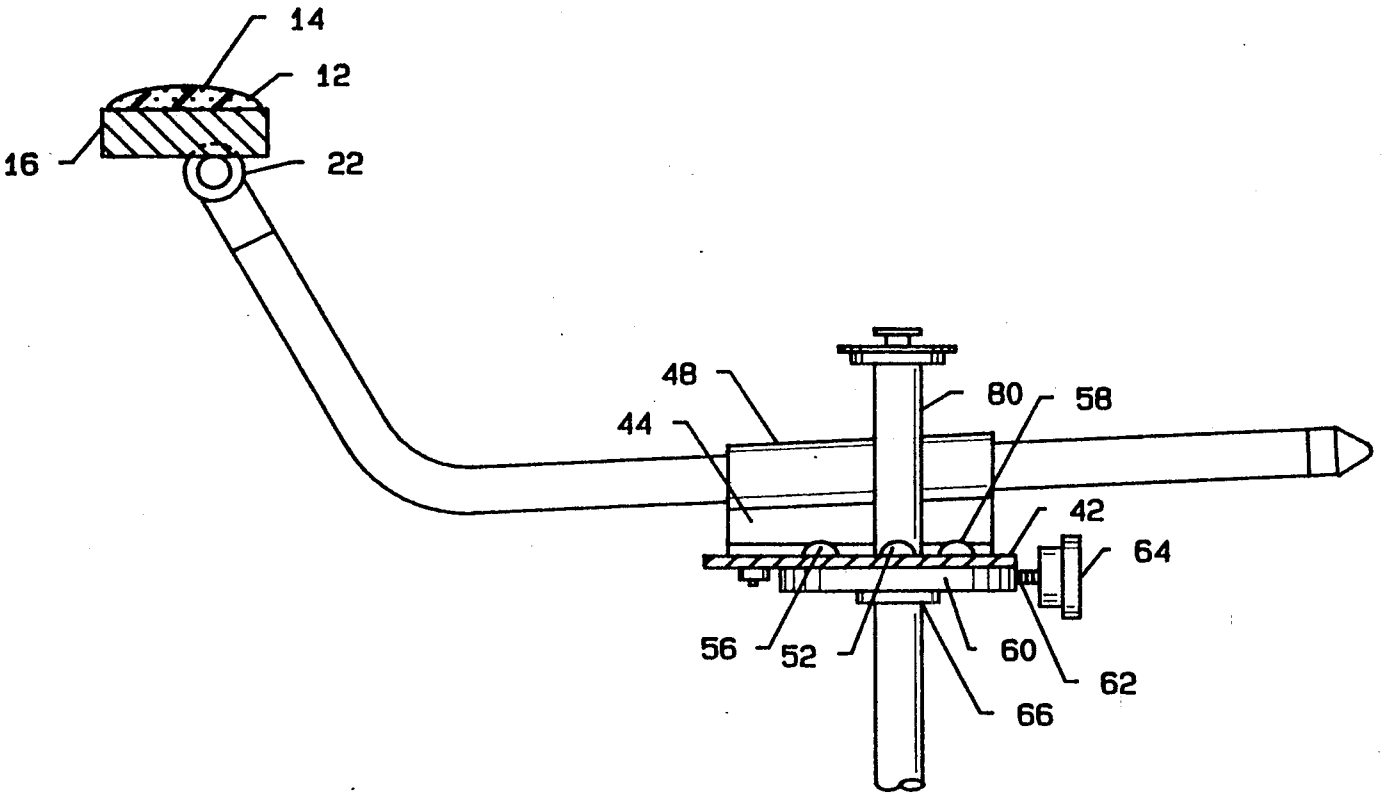
FIG. 2 illustrates a view taken along line 2—2 of FIG. 1.

FIG. 1 illustrates a top view of an arm and hand rest of the present invention 10, including a padded foam member 12 with a slight curvature 14, as illustrated in FIG. 2. A longitudinal rectangular housing 16 with rounded ends 18 and 20 supports the padded foam member 12. U-shaped flanges 22 and 24, as illustrated in dashed lines and as also illustrated in FIG. 2, secure to the underside of the rectangular housing 16. Angled configured supports 26 and 28 include ends with holes 30 and 32 and rounded ends 34 and 36. Screws 38 and 40 extend through flanges 22 and 24, through the hole ends 30 and 32, through the other sides of the flanges 22 and 24, and secure into one side of the U-shaped flanges which are threaded for securing of the housing 16 with respect to the supports 26 and 28. The screws 38 and 40 can be thumb screws for ease of adjustability. A base 42 with wrap-around ends 44 and 46 secure the configured supports 26 and 28. Wrap-around ends 44 and 45 include slightly inclined portions 48 and 50. The inclined portion 48 of wrap-around end 44 is illustrated in FIG. 2. Screws 52, 54, 56 and 58 secure the wrap-around ends 44 and 46 of base 42 to the base 42. A screw housing 60 secures to the base 42 with screws 52–58 likewise. The screw housing 60 includes a threaded screw member 62 and a knob attached thereto 64. A hole 66 extends up through the base 42 and the screw housing 60.

FIG. 2 illustrates a view taken along line 2—2 of FIG. 1 where all numerals correspond to those elements previously described. Particularly illustrated is the flange 22 and the inclined portion 48 of the wrap-around end 44.

Figure 3:
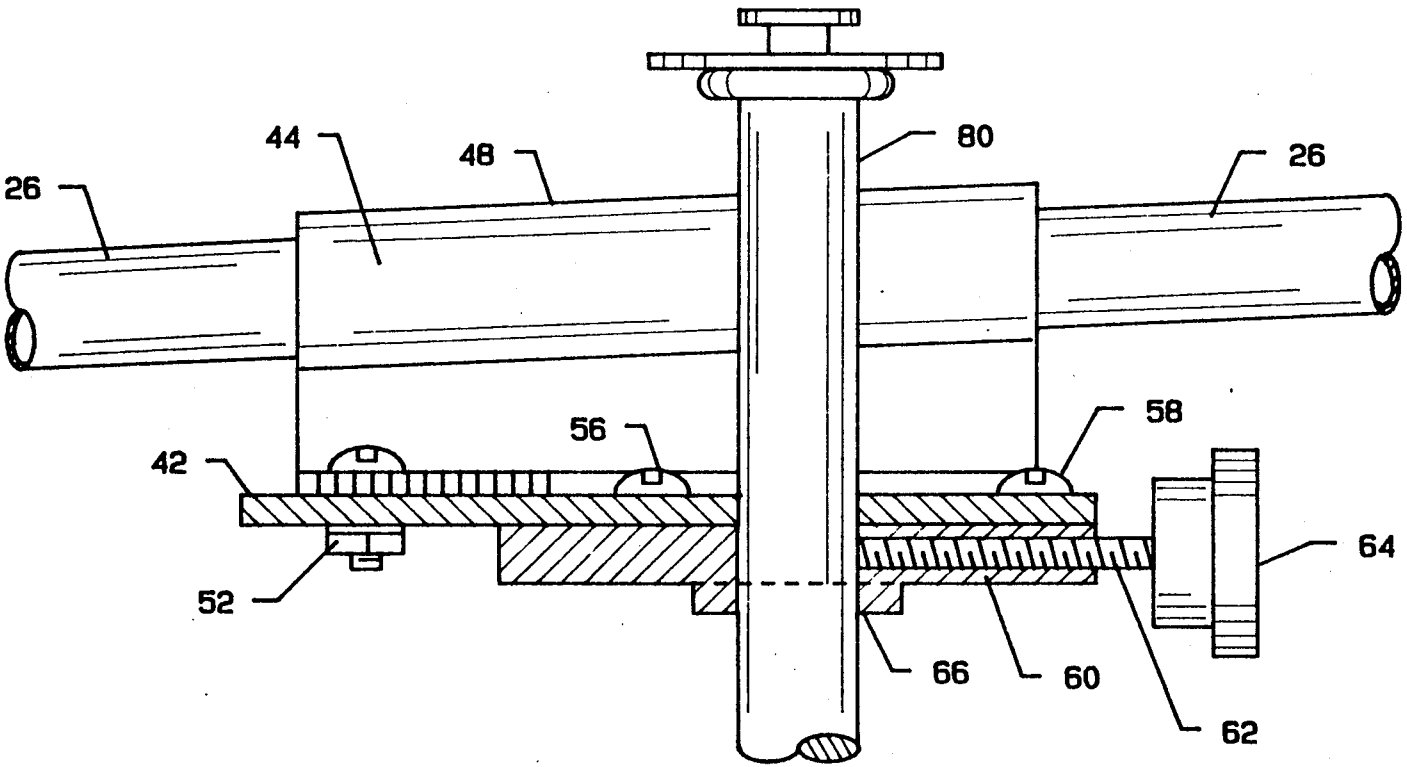
FIG. 3 illustrates an enlarged view of the base structure.

FIG. 3 illustrates an enlarged view of the base 42 and the screw housing 60. All numerals correspond to those elements previously described.

MODE OF OPERATION

Figure 4:
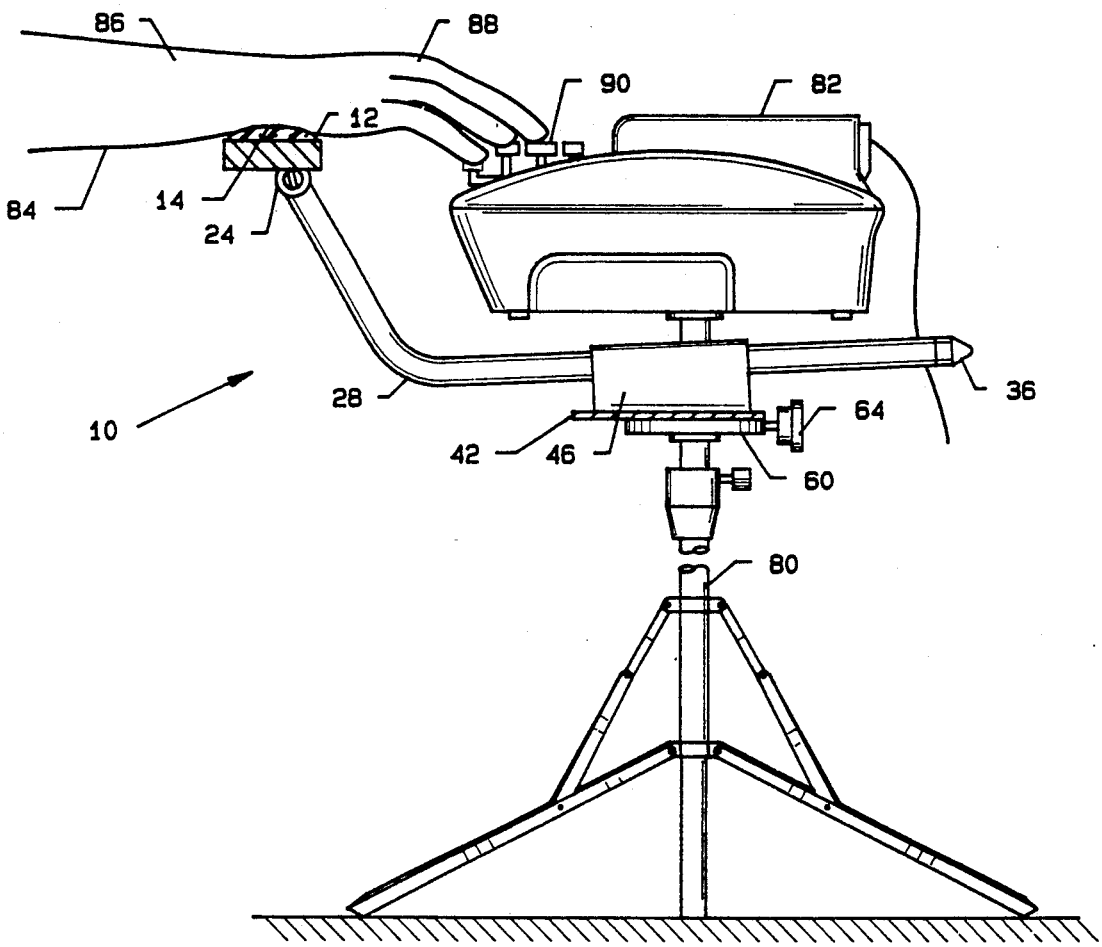
FIG. 4 illustrates a side view of the arm and hand rest with a stenography machine.

FIG. 4 illustrates a side view of the present invention, an arm and hand rest 10 affixed to a court reporter's stand 80, as is generally well known in the art, including supporting of a stenography machine 82. Particularly illustrated is an individual's arm 84, including the wrist 86 and the fingers 88 across the keys 90 of the stenography machine 82. Either during a typing action or during a rest action, the lower portion of the arm, as well as the wrist can rest on the padded foam member 12 where the slight curvature 14 of the member provides adequate support for preventing carpal tunnel syndrome (CTS) and repetitive strain injuries (RSI). While a court reporter's stand has been illustrated by way of example and for purposes of illustration only, it is not to be construed as limiting of the present invention in that the arm and hand rest 10 can be utilized with any type of keyboard, such as that of a computer keyboard, personal computer keyboard, word processor keyboard, or any other type of keyboard. Three dimensional mounting of the keyboard about a keyboard is based on the principle of the pole 80 which is positioned about the keyboard as taught in the figures.

Figure 5:
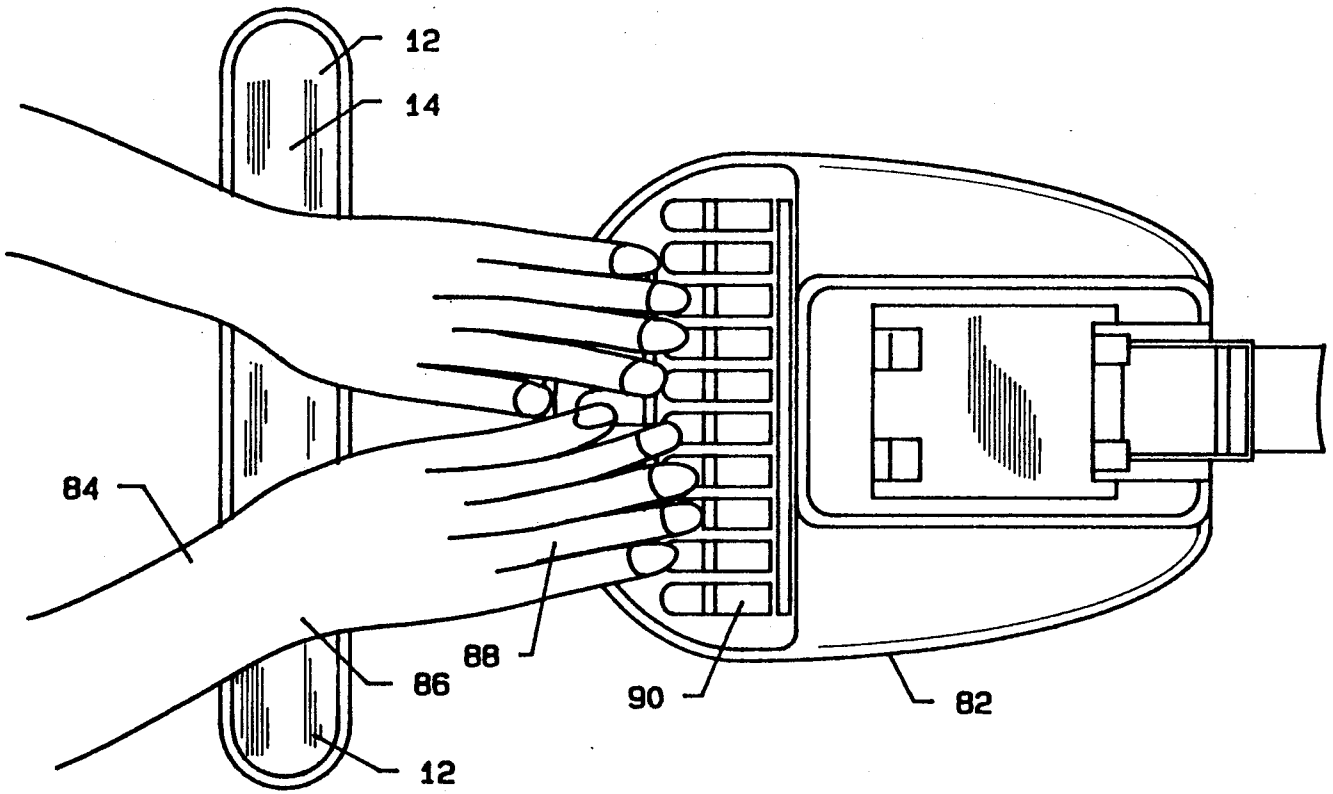
FIG. 5 illustrates a top view of FIG. 4.

FIG. 5 illustrates a top view of FIG. 4 where all numerals correspond to those elements previously described.

DESCRIPTION OF THE ALTERNATIVE EMBODIMENT

Figure 6:
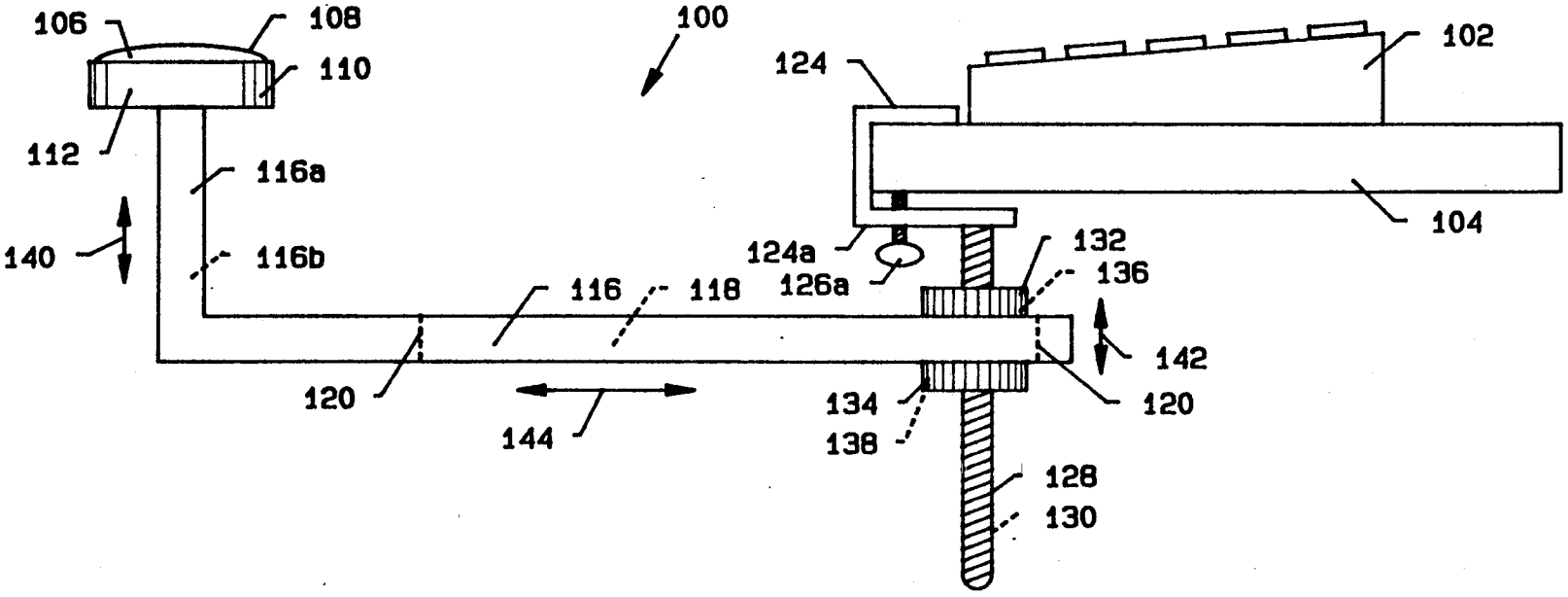
FIG. 6 an alternative embodiment, illustrates a side view of an arm and hand rest for use with a computer keyboard; and, FIG. 7, an alternative embodiment, illustrates a top view of FIG. 6.
Figure 7:
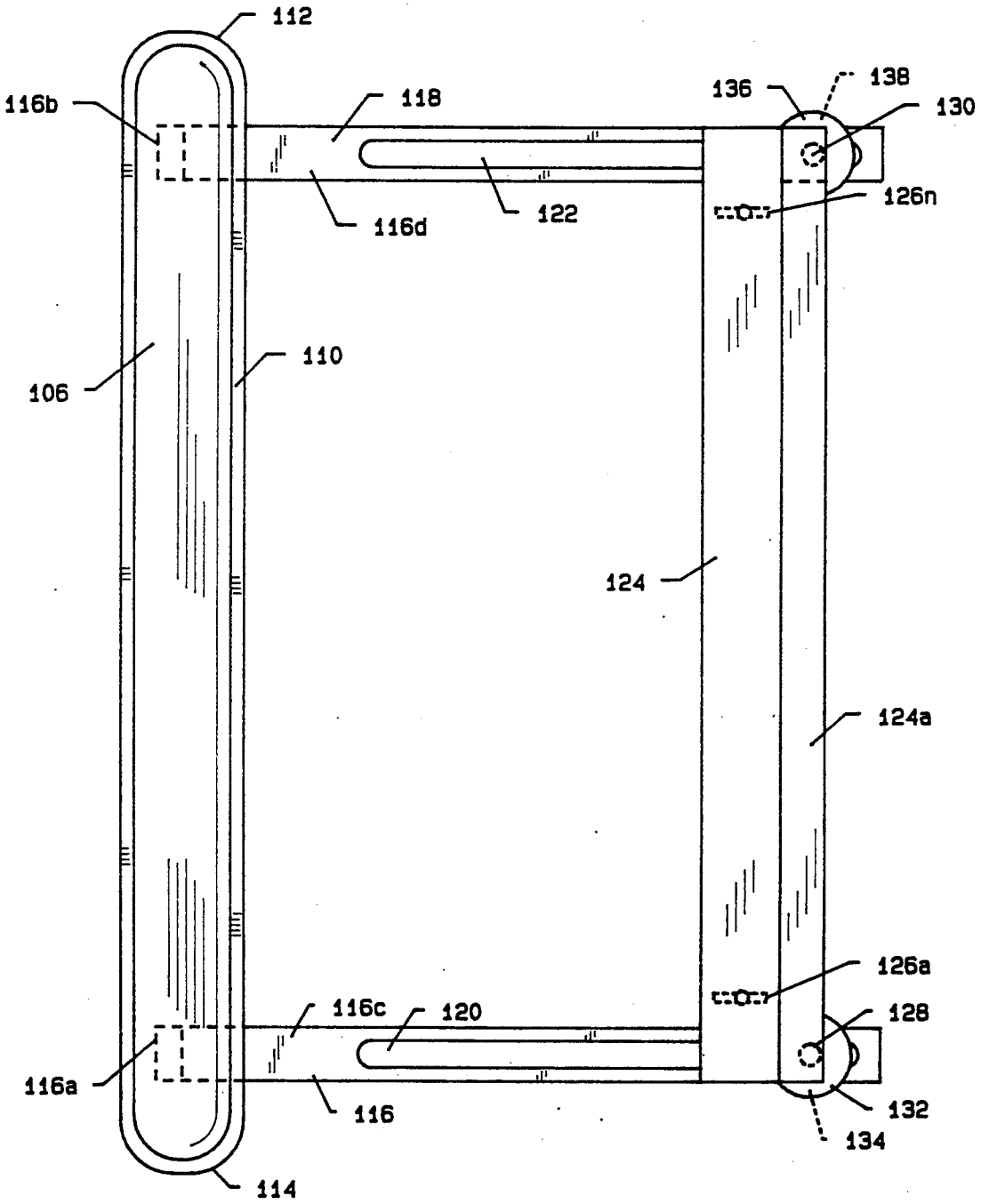

FIGS. 6 and 7, alternative embodiments, illustrate an arm and hand rest 100 for use in conjunction with a computer keyboard 102. The arm and hand rest 100 secures to a table top 104 so that the arm and hand rest 100 can provide arm and hand support when using a computer keyboard 102. The arm and hand rest 100 is adjustable in both the horizontal and vertical planes. A padded foam member 106 with a slight curvature 108 mounts on a longitudinal rectangular housing 110 with rounded ends 112 and 114. The longitudinal rectangular housing 110 and the padded foam member 106 secure to the vertically oriented members **116*a* and 116*b* of the slotted bar supports 116 and 118. The horizontal portions 116*c* and 116*d* of slotted bar supports 116 and 118 include longitudinal slots 120 and 122**, respectively.

A horizontally aligned securement channel 124 secures over the table top 104 with a plurality of thumb screws **126*a*–126*n* aligned vertically through the bottom member 124*a* of the channel 124 and allows for movement horizontally of the arm and hand rest horizontally along the edge of the table top 104. Threaded rods 128 and 130 are secured to the bottom member 124*a* of the channel 124 and extend vertically downward therefrom through the slots 120 and 122 in the slotted bar supports 116 and 118, respectively. Thumb wheels 132 and 134 adjust upwardly or downwardly on the threaded rod 128 and over, about and against the slotted bar support 116 to affix the slotted bar support vertically along the threaded rod 128. A similar set of thumb wheels 136 and 138 perform a like function with respect to the threaded rod 130 and the slotted bar support 118. Vertical movement of the slotted bar supports 116 and 118 with the attached rectangular housing 110 and pad 106 with reference to the table top 104 and computer keyboard 102 is indicated by double arrows 140 and 142. The longitudinal slotted bar supports 116 and 118 are in alignment with the vertical threaded rods 128 and 130, and adjust horizontally to position the pad 106 and rectangular housing 110 horizontally with respect to the table top 104 and computer keyboard 106 as indicated by double arrow 144**.

Various modifications can be made to the present invention without departing from the apparent scope thereof.

We claim:

1. Arm and hand rest comprising:

a. padded foam means mounted on a longitudinal rectangular housing: and, b. opposing mirror image configured supports for supporting said longitudinal housing at first ends at the supports and the second end of the supports being mounted to a base, the base being mounted for rotational movement through a hole therein and about a post of a keyboard stand, providing for three dimensional movement of the arm rest relative to a keyboard mounted on the stand.

2. The arm and hand rest of claim 1 further comprising a set screw structure for fixing the height of the base, and wherein the mounting of the second end of the supports of the base is a slidable attachment for adjusting the spacing of the padded foam means relative to the post.

* * * * *